US007207738B2

(12) United States Patent
Kanari et al.

(10) Patent No.: US 7,207,738 B2
(45) Date of Patent: Apr. 24, 2007

(54) WRITING INSTRUMENT

(75) Inventors: Hiroyuki Kanari, Fukushima-ken (JP); Yasuhiro Sanpei, Fukushima-ken (JP)

(73) Assignee: Micro Co., Ltd. (JP)

( * ) Notice: Subject to any disclaimer, the term of this patent is extended or adjusted under 35 U.S.C. 154(b) by 0 days.

(21) Appl. No.: 11/477,850

(22) Filed: Jun. 29, 2006

(65) Prior Publication Data

US 2007/0014622 A1 Jan. 18, 2007

(30) Foreign Application Priority Data

Jul. 14, 2005 (JP) ..... 2005-205681

(51) Int. Cl.
*B43K 21/16* (2006.01)

(52) U.S. Cl. ..... 401/65; 401/82; 401/93; 401/94; 401/115

(58) Field of Classification Search ..... 401/65–67, 401/82, 92–94, 115
See application file for complete search history.

(56) References Cited

U.S. PATENT DOCUMENTS 4,205,924 A * 6/1980 Sumita ..... 401/65
5,149,219 A * 9/1992 Kageyama et al. ..... 401/65
5,171,097 A * 12/1992 Nagaoka et al. ..... 401/65
5,354,141 A * 10/1994 Watanabe ..... 401/65

FOREIGN PATENT DOCUMENTS

JP 63191080 12/1988

* cited by examiner

*Primary Examiner*—Tuan Nguyen
(74) *Attorney, Agent, or Firm*—Adams & Wilks

(57) ABSTRACT

A writing instrument is capable of functioning both as an automatic mechanical pencil and as a shaking-type mechanical pencil. The writing instrument has a barrel cylinder constituted by a front cylinder detachably connected to a rear cylinder. A slider is disposed at the front end of the barrel cylinder, and a lead chuck, such as a ball chuck, is disposed rearwardly of the slider. A slider spring urges the slider forward and urges the lead chuck rearward. A lead reservoir is movably disposed rearwardly of the lead chuck. Around the outer periphery of the lead reservoir, a weight is disposed to undergo back-and-forth movement in an axial direction. On the outer periphery of the lead reservoir is disposed a weight-receiving cylinder against which the rear end of the weight abuts when the writing instrument is shaken. A knocking spring urges the weight-receiving cylinder forward and urges the lead reservoir rearward.

20 Claims, 6 Drawing Sheets

WRITING INSTRUMENT

BACKGROUND OF THE INVENTION (1) Field of the Invention

The present invention relates to a writing instrument having a function of an automatic mechanical pencil in which lead is automatically fed when a front end of the writing instrument is lifted from a writing surface during a writing operation, and a function of a shaking-type mechanical pencil in which lead is fed by shaking the writing instrument.

(2) Description of Related Art

A writing instrument having a function of an automatic mechanical pencil and a function of a shaking-type mechanical pencil is disclosed, for example, in Japan Published Utility Model No. 63-191080. The writing instrument of this type has a slider frictionally holding the lead at the front end of a barrel cylinder, and the slider is disposed to undergo movement in an axial direction and is urged in the forward direction by a spring. A lead chuck, e.g., a ball chuck, is disposed rearwardly of the slider to undergo movement in the axial direction and holds the lead in such a manner as to allow forward movement of the lead but prevent backward movement thereof. A weight is movably disposed rearwardly of the lead chuck. During writing, the slider retracts as the lead abrades and is consumed, and when the front end of the writing instrument is separated or lifted from the paper, the slider advances while holding the lead, whereby the lead is automatically fed. Further, when the barrel cylinder is shaken, the weight moves forward and backward and impacts the lead chuck, whereby the lead chuck advances to feed the lead.

In known writing instruments of this type, the weight can freely move and collide with a member disposed at the end of its movement stroke, whereby the member may be damaged. When this member is, for example, a knocking button attached to the barrel cylinder, the knocking button may become detached. Further, such known writing instruments have a complicated structure, cannot be easily altered to cancel the function of a shaking-type mechanical pencil so as to limit the mechanical pencil to the function of an automatic mechanical pencil, and cannot be used as a knocking-type mechanical pencil.

SUMMARY OF THE INVENTION

It is an object of the present invention to provide a writing instrument having a function of an automatic mechanical pencil and a function of a shaking-type mechanical pencil, in which even when a weight is moved by shaking the barrel cylinder, the weight will not damage a member disposed in the barrel cylinder and will not dislocate a knocking button, etc. disposed at the rear of the barrel cylinder.

A further object of the present invention is to provide a writing instrument in which the function of a shaking-type mechanical pencil can be simply cancelled so that the writing instrument can be used as a knocking-type mechanical pencil, and which has a simple structure and can be manufactured at low cost.

The writing instrument of the present invention comprises a slider frictionally holding a lead and movably disposed at a front end of a barrel cylinder. A lead chuck is disposed rearwardly of the slider and holds the lead in such a manner as to allow forward movement of the lead, but prevent backward movement thereof. The slider is resiliently urged forward, and when the front end of the writing instrument is separated or lifted from a writing surface, the lead is automatically fed in such a state that it is held by the slider. The lead chuck is disposed to undergo movement in an axial direction and is urged rearward by a first urging means. A lead reservoir is disposed rearwardly of the lead chuck to supply lead to the lead chuck. A weight is disposed around the outer periphery of the lead reservoir and is movable in an axial direction so as to abut against the rear end of the lead chuck. On the outer periphery of the lead reservoir, a weight-receiving cylinder is formed against which the weight abuts, and the weight-receiving cylinder is urged forward by a second urging means.

The barrel cylinder comprises a front cylinder detachably connected to a rear cylinder. The outer periphery of the lead reservoir is provided with a flange which opposes the weight-receiving cylinder. The outer periphery of the weight-receiving cylinder is provided with a receiving flange which abuts against the rear end of the front cylinder. The rear cylinder is provided with an inner stepped portion against which the flange of the lead reservoir abuts.

During use of the writing instrument, when the weight moves forward and collides with the lead chuck, the lead is fed. When the weight moves backward and collides with the weight-receiving cylinder, the impact is buffered by the second urging means which urges the weight-receiving cylinder forward to thereby prevent damage to the respective members, etc. Further, the lead reservoir may be used by moving it in a knocking style. Furthermore, when the front cylinder and the rear cylinder are separated, the weight-receiving cylinder, the lead reservoir, etc. can be easily taken out of the separated cylinders, and the weight may be removed, whereby the function of a shaking-type mechanical pencil can be simply cancelled.

DETAILED DESCRIPTION OF THE INVENTION

Figure 1:
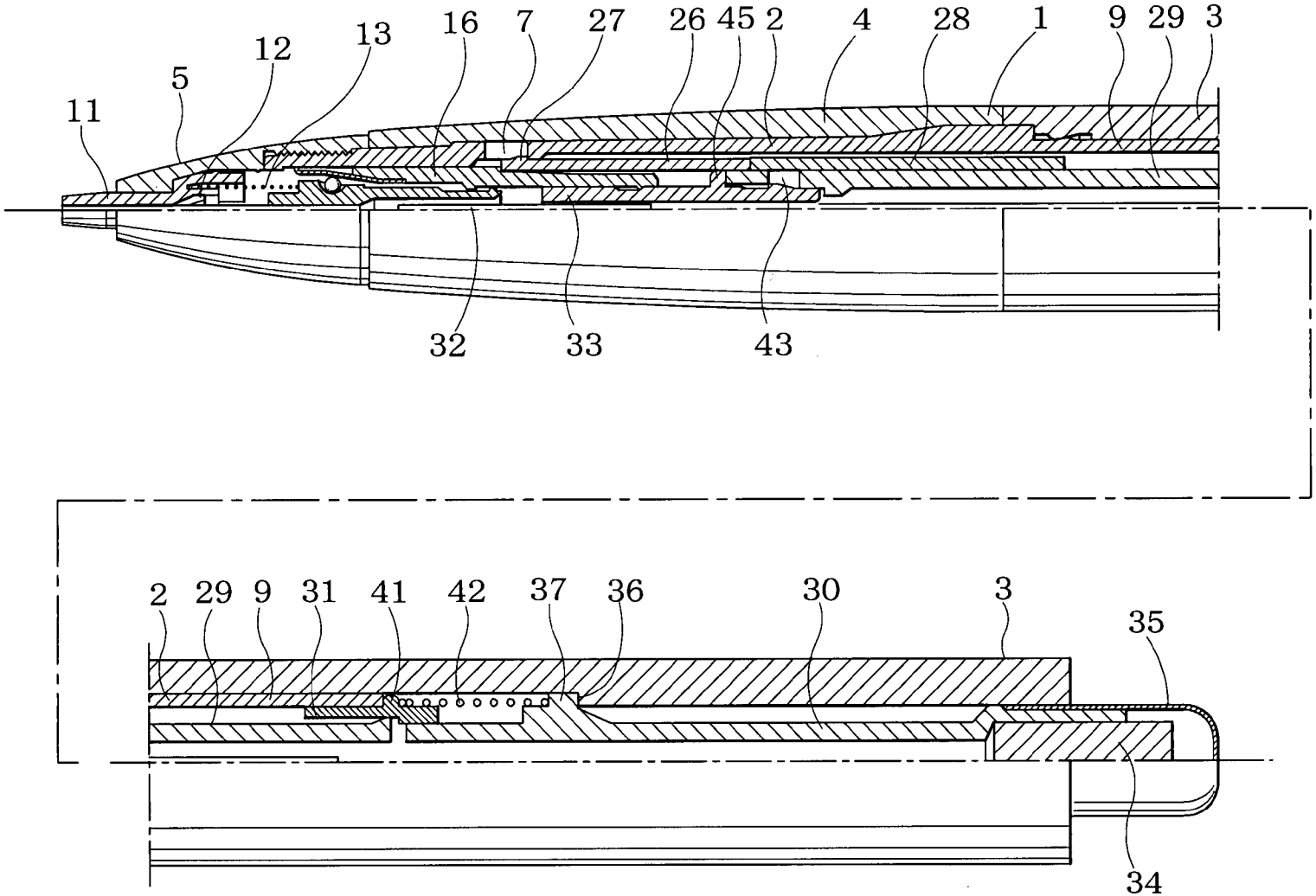
FIG. 1 is a semi-cross sectional side view showing one embodiment of a writing instrument according to the present invention.
Figure 2:
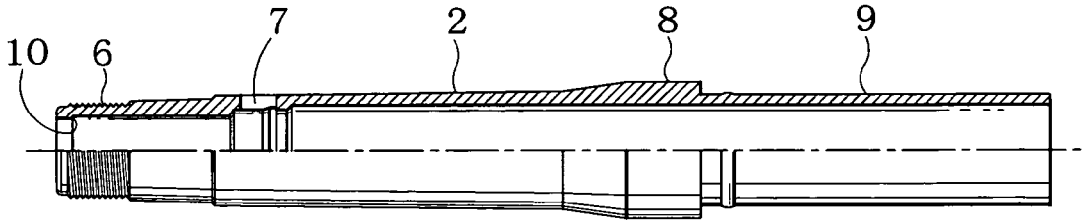
FIG. 2 is a semi-cross sectional side view showing a front cylinder of the writing instrument.
Figure 3:
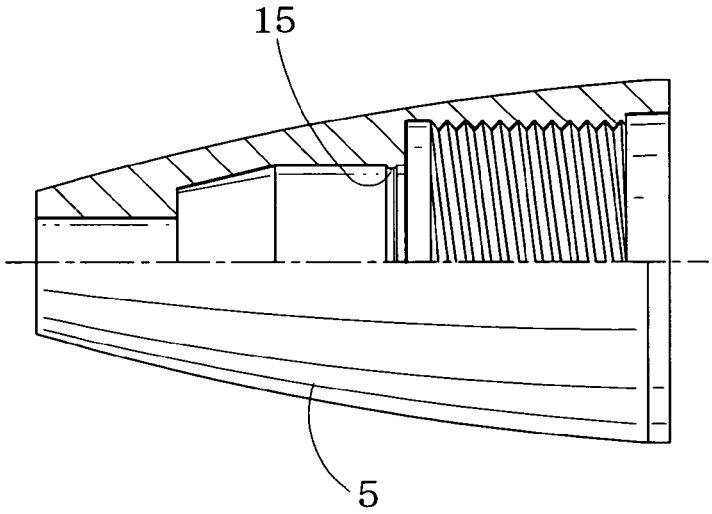
FIG. 3 is a semi-cross sectional side view of a nose cone of the writing instrument.

FIGS. 1–12 show one embodiment of a writing instrument embodying the principles of the present invention. As shown in FIG. 1, the writing instrument comprises a barrel cylinder 1 formed of a front cylinder 2 and a rear cylinder 3. As used herein, the term "cylinder" means a tubular member as well known and used in the writing instrument art. The front and rear cylinders 2 and 3 are detachably connected together by a known detachable connecting structure, such as a screw coupling, a snap-fit coupling and the like. A grip tube 4 is fitted around the front portion of the front cylinder 2 to facilitate gripping of the writing instrument by a user. As shown in FIG. 2, a threaded portion 6 is formed at the front end of the front cylinder 2 for threadedly attaching a nose cone 5 (FIG. 3).

As shown in FIG. 2, the front cylinder 2 has an axial grove 7 formed at a front portion thereof, the groove extending in the axial direction of the front cylinder 2. The front cylinder 2 has at an intermediate portion thereof a large diameter section 8 which tapers inwardly in the forward direction and with which the rear portion of the grip tube 4 is frictionally fitted. The rear portion of the front cylinder 2 is provided with a cylindrical portion 9 which is inserted into the front portion of the rear cylinder 3 to form the barrel cylinder 1. The front end of the front cylinder 2 is provided with an inner stepped portion 10.

A slider 11 (FIG. 4) is movably disposed in the nose cone 5 to undergo movement in the axial direction between retracted and advanced positions. The slider 11 is provided with a holding portion 12 which frictionally holds the writing instrument lead as conventionally known. The holding portion 12 is made of rubber, elastic clamping pieces, etc. The slider 11 is urged forwardly by a slider spring 13. A holding mechanism is provided to temporarily hold or retain the slider 11 at the retracted position so as not to cause advancement of the slider to the advanced position and the feeding of the lead when carrying the writing instrument.

Figure 4:
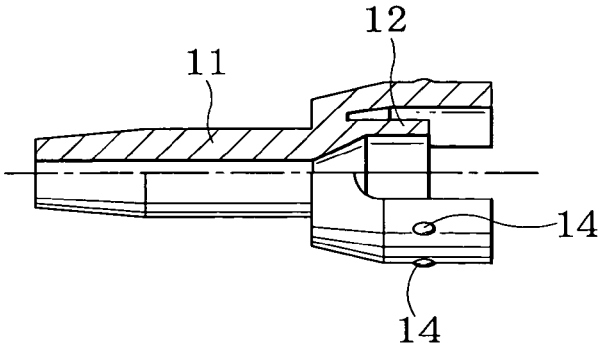
FIG. 4 is a semi-cross sectional side view of a slider of the writing instrument.
Figure 5:
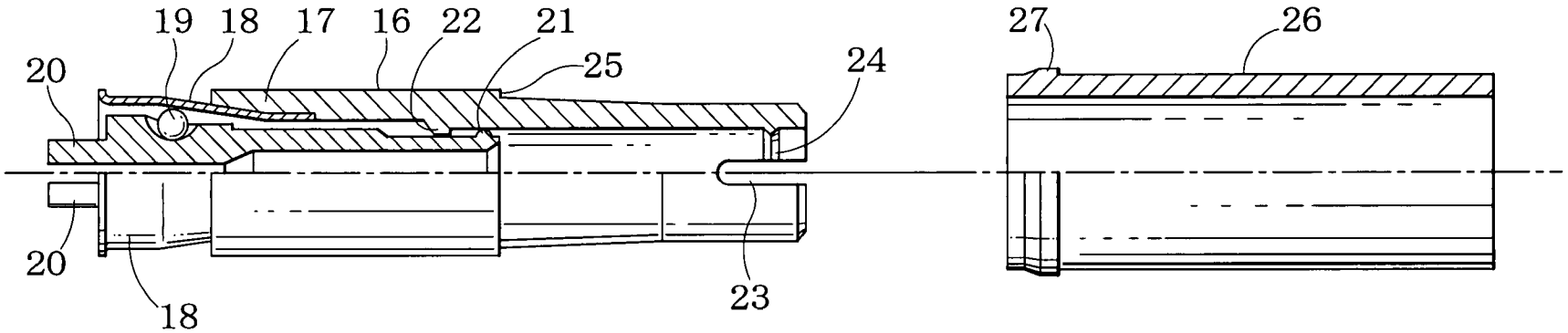
FIG. 5 is a semi-cross sectional side view of a lead chuck of the writing instrument.

In the examples shown in FIG. 3 and FIG. 4, as a temporary holding mechanism, a series of small engagement projections 14 are provided in circumferentially spaced relation around the outer periphery of the slider 11, and an annular engagement projection 15 that projects radially inwardly is provided on the inner face of the nose cone 5. When the slider 11 is retracted to the position at which the engagement projections 14 of the slider 11 clear the engagement projection 15 of the nose cone 5, the engagement projections 14, 15 engage together with sufficient force so that the slider 11 will not advance by the urging action of the slider spring 13. This engagement can be, as described below, disengaged by knocking the lead reservoir to advance the lead chuck and press the slider 11 forwardly. Other suitable holding mechanisms may be used.

In the front cylinder 2, a lead chuck 16 is movably disposed to undergo movement in the axial direction, and the lead chuck is located rearwardly of the slider 11. The lead chuck 16 may be a ball chuck mechanism or other known mechanism constructed to effect forward movement of the lead but prevent backward movement thereof. In the example shown in FIG. 5, the lead chuck 16 comprises a ring 18 provided at the front part of a cylindrical chuck main body 17, and a plurality, usually two, of chuck elements 20,20 partially surrounding the lead and inserted into the ring 18. The ring 18 is flared outwardly in the forward direction, and one or more balls 19 are interposed between the flared portion of the ring 18 and the chuck elements 20,20.

When the lead retracts, the one or more balls 19 shift to a small diameter part of the ring 18 to releasably clamp the lead, and when the lead advances, the one or more balls 19 shift to a large diameter part of the ring 18 to release the clamped lead to permit advancement thereof. At the rear ends of the chuck elements 20,20 and on the inner face of the chuck main body 17, detachment-preventing projections 21,22 are formed which abut against each other when the chuck elements advance, thereby preventing detachment of the chuck elements.

At the rear end of the chuck main body 17 of the lead chuck 16, a slit 23 is formed so that the rear end of the chuck main body 17 can be resiliently radially enlarged, and a sliding projection 24 projects inwardly from the inner periphery of the chuck main body. Further, at the intermediate part of the outer periphery of the chuck main body 17, an outer stepped portion 25 is formed, and a sleeve 26 is mounted thereon from the rear until the sleeve abuts against the outer stepped portion 25. The sleeve 26 has a guide projection 27 on its outer periphery. The guide projection 27 slidably engages with the axial groove 7 of the front cylinder 2, and at the position corresponding to the rear end of the axial groove 7, receives the writing pressure at the time of writing and prevents detachment of the lead chuck 16.

The lead chuck 16 is movable in the axial direction and guided by the axial groove 7 until the front end of the ring 18 reaches the inner stepped portion 10 of the front cylinder 2, and the lead chuck 16 is urged backward or rearward by the slider spring 13 which constitutes a first urging means. In the example shown in FIG. 1, the rear end of the slider spring 13 which urges the slider 11 forward abuts against the front ends of the chuck elements 20,20, by which the slider 11 and the lead chuck 16 are urged forward and backward, respectively, by the one spring 13. Alternatively, as the first urging means, a spring (not shown) separate from the slider spring 13 may be disposed to urge the lead chuck backward.

At the rear of the lead chuck 16, a tubular weight 28, preferably of cylindrical shape, is inserted so that it can abut against the rear end of the sleeve 26, and a lead reservoir 29 is disposed to feed the lead to the lead chuck. The weight of the weight 28 is smaller than the spring load of the first urging means, namely, the slider spring 13, i.e., the weight of the weight 28 is smaller than the spring force exerted by the slider spring 13.

With reference to FIG. 6 to FIG. 10, the lead reservoir 29 has a cylindrical reservoir main body 30, a tubular impact member such as a weight-receiving cylinder 31 which is slidably fitted to the outer periphery of the reservoir main body 30, and a pipe holder 33 having a lead-supplying pipe 32.

Figure 7:
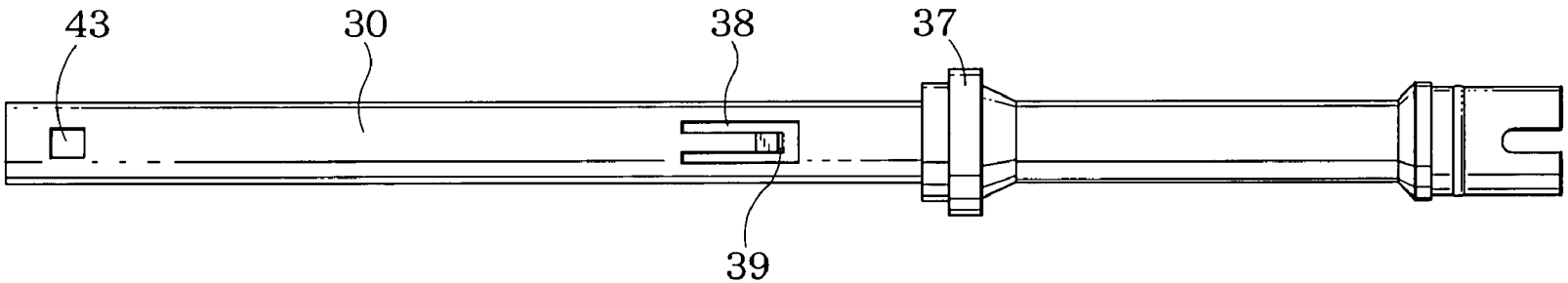
FIG. 7 is a front view of a main body of the lead reservoir of the writing instrument.
Figure 8:
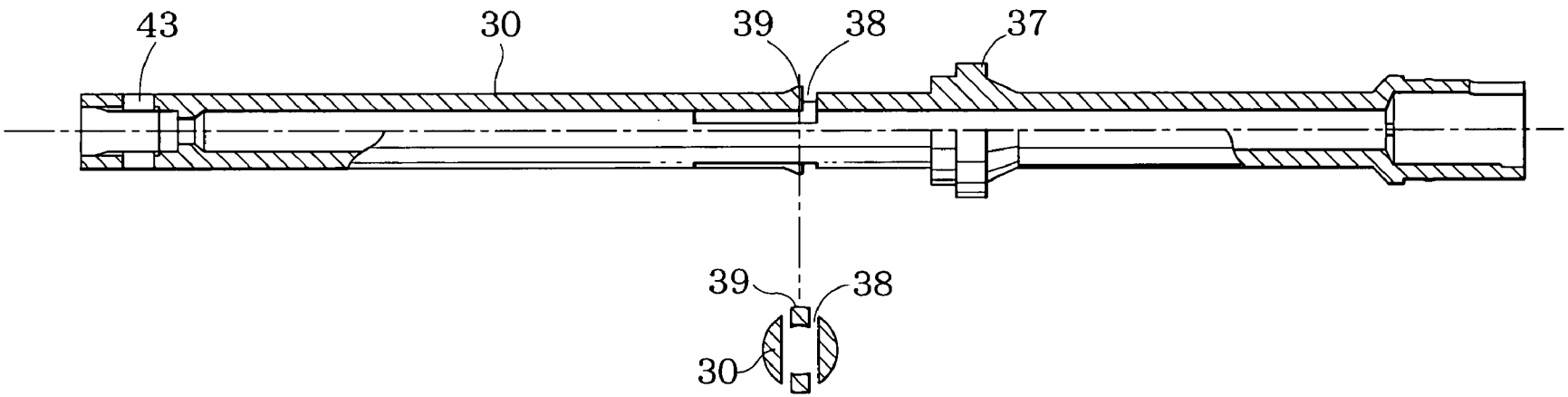
FIG. 8 is a partially cutaway side view showing a part of the main body of the lead reservoir of the writing instrument.

As shown in FIG. 1, an eraser 34 is removably attached at the rear end of the reservoir main body 30, and a knocking member in the form of a knocking cap 35 is removably inserted between the rear end of the reservoir main body 30 and the rear end of the rear cylinder 3 so as to cover the eraser 34. A flange 37 is formed at an intermediate part of the reservoir main body 30 and is engageable with an inner stepped portion 36 of the rear cylinder 3. As shown in FIGS. 7 and 8, a pair of U-shaped notches 38 are formed opposite one another at the intermediate part of the reservoir main body 30, each notch 38 forming an engagement click 39 that projects outwardly. The engagement clicks 39 engage with an engagement edge portion 40 formed inside the weight-receiving cylinder 31 (FIG. 10).

Figure 10:
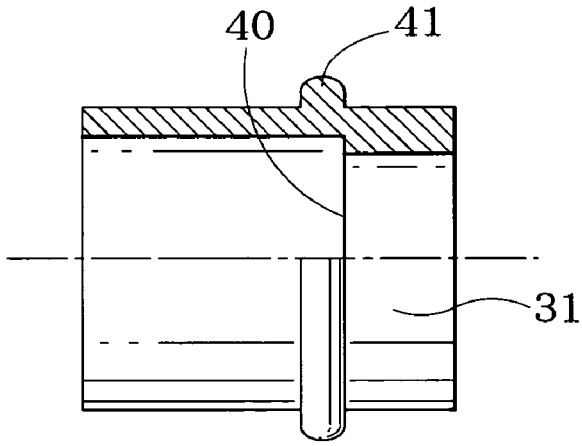
FIG. 10 is a semi-cross sectional side view of a weight-receiving cylinder of the writing instrument.

The weight-receiving cylinder 31 has a receiving flange 41 on its outer periphery as shown in FIG. 10. Between the receiving flange 41 and the flange 37 of the reservoir main body 30, a knocking spring 42 which constitutes a second urging means is disposed. The weight-receiving cylinder 31 is urged forward by the knocking spring 42 until the receiving flange 41 abuts against the rear end of the cylindrical portion 9 of the front cylinder 2, and the lead reservoir 29 is urged backward. The lead reservoir 29 retracts to the position where the flange 37 of the reservoir main body 30 abuts against the inner stepped portion 36 of the rear cylinder 3, and the lead reservoir 29 is advanced by a knocking operation of the knocking cap 35. In the illustrated example, as the second urging means, the knocking spring 42 is used to urge the weight-receiving cylinder 31 and the lead reservoir 29 in opposite directions, but separate spring members may be provided to urge the members in opposite directions.

Figure 9:
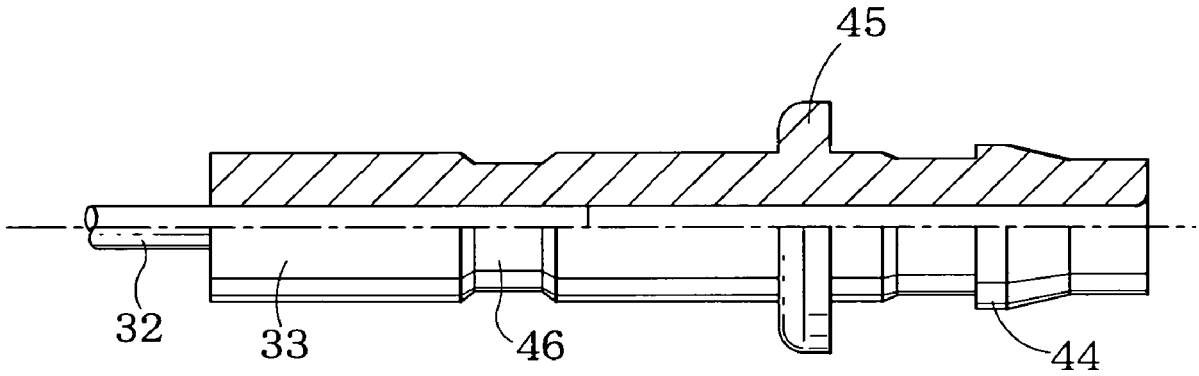
FIG. 9 is a semi-cross sectional side view of a pipe holder of the writing instrument.

The pipe holder 33 has, as shown in FIG. 9, an engaging portion 44 which engages with an engaging hole 43 provided on the side wall of the reservoir main body 30 (FIG. 7), and a flange 45 which abuts against the front end of the reservoir main body 30 when the pipe holder 33 is inserted into the reservoir main body 30.

The lead-supplying pipe 32 of the pipe holder 33 can be inserted from the rear end of the lead chuck 16 into the gap between chuck elements 20,20. A receiving groove 46 is formed on the outer periphery of the pipe holder 33, and the sliding projection 24 formed on the inner face of the rear end of the lead chuck 16 is fitted into the receiving groove 46.

Figure 11:
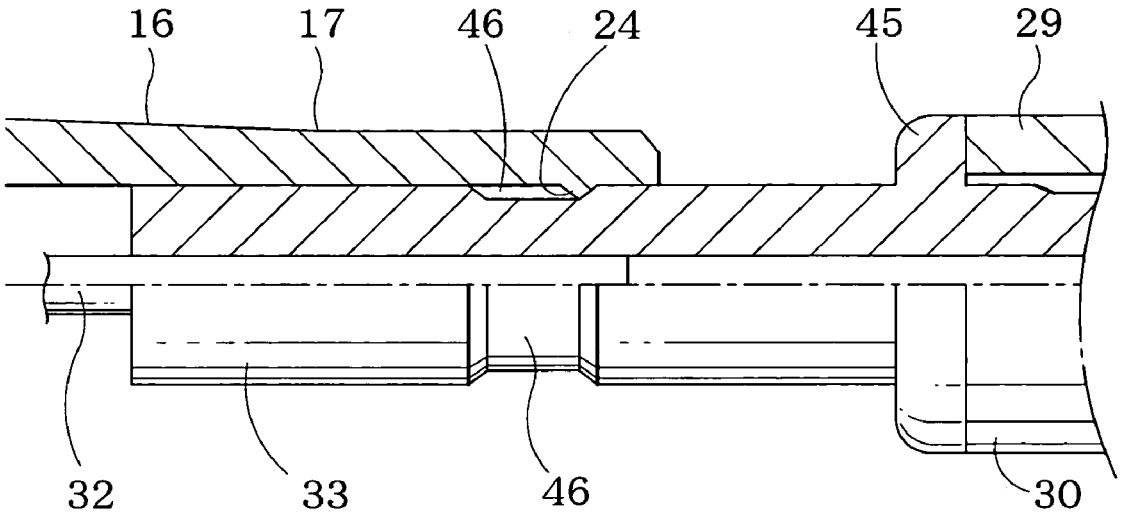
FIG. 11 is an explanatory view showing the relation between a receiving groove of the pipe holder and a sliding projection of the lead chuck of the writing instrument.
Figure 12:
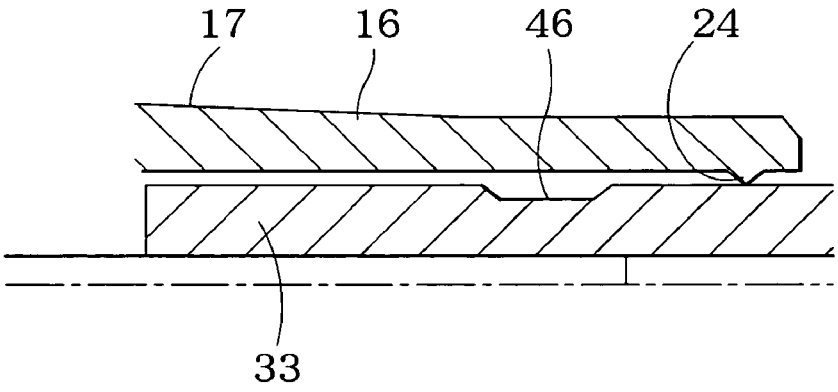
FIG. 12 is an explanatory view showing the state in which the sliding projection is disengaged from the receiving groove of the pipe holder.

The receiving groove 46 is formed in such a length that, as shown in FIG. 11, when the lead chuck 16 is advanced by the shaking action of the weight 28 in a shaking mode of operation, the sliding projection 24 can freely move within the receiving groove 46, but the lead reservoir 29 will not be displaced together with the lead chuck. When the lead reservoir 29 is advanced by knocking in a knocking mode of operation, the rear end edge of the receiving groove 46 abuts against the sliding projection 24 to forwardly displace the lead chuck 16 and thereby feed the lead. When the ring 18 of the lead chuck 16 abuts against the inner stepped portion 10 of the front cylinder 2, further forward movement of the lead chuck 16 is thereby prevented, and the sliding projection 24 slidingly disengages from the receiving groove 46 and comes in sliding contact with the outer periphery of the pipe holder 33, as shown in FIG. 12. The lead reservoir 29 is further advanced to insert the lead-supplying pipe 32 into the gap between the chuck elements 20,20 so as to advance the chuck elements 20,20 and release the clamping of the lead by the chuck elements. When the knocking operation is stopped, the lead reservoir 29 returns to the state of FIG. 11 by the action of the knocking spring 42, and the chuck elements 20,20 clamp the lead again on the way to this state to enable a writing operation. Furthermore, as described above, in a case where the slider 11 is temporarily held at the retracted position, by advancing the lead chuck 16 by a knocking operation, the slider 11 is pressed forward to release the temporary hold.

During normal use of the writing instrument, the slider 11 gradually retracts with wear or consumption of the lead, and when the writing front end of the writing instrument is released from the writing surface, the slider 11 advances by the action of the slider spring 13, whereby the lead can be fed and the writing instrument functions as an automatic mechanical pencil.

In a knocking mode, when the rear end of the lead reservoir 29 is knocked, the lead chuck 16 advances and the lead can be fed, whereby the writing instrument functions as a knocking-type mechanical pencil.

In a shaking mode, when the weight 28 is displaced back-and-forth in an axial direction by shaking the barrel cylinder 1, the weight 28 abuts or impacts against the rear end of the sleeve 26 with sufficient impact force to advance the lead chuck 16, whereby the lead can be fed. In this instance, the impact of the retracted weight 28 can be buffered or absorbed to a desired degree by the knocking spring 42 of the weight-receiving cylinder 31 so as not to adversely affect the respective parts. Since the weight of the weight 28 is set to be smaller than the spring load of the slider spring 13 which urges the lead chuck 16 backward, the lead chuck 16 retracts when the shaking of the barrel cylinder 1 is stopped. Further, since the sliding projection 24 of the lead chuck 16 can freely slide within the receiving groove 46 of the lead reservoir 29, the lead chuck can be advanced by a small force. The writing instrument can thus function as a shaking-type mechanical pencil.

Figure 6:
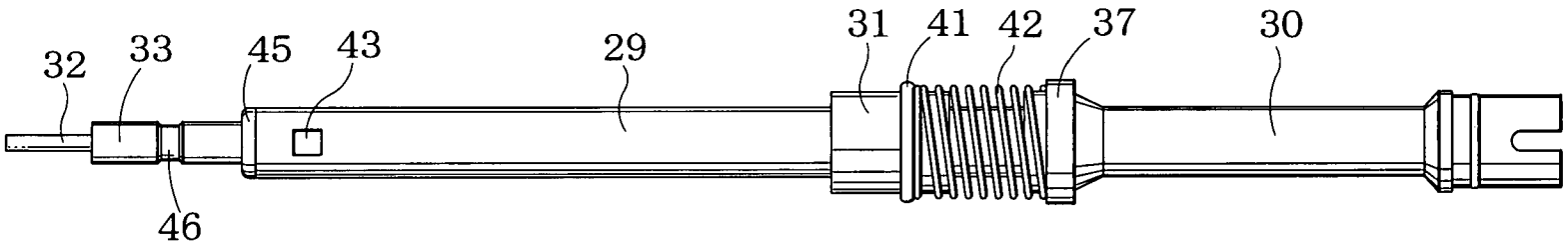
FIG. 6 is a side view of a lead reservoir of the writing instrument.

The function of the shaking-type mechanical pencil can be cancelled by separating the front cylinder 2 from the rear cylinder 3, and then detaching the lead reservoir 29 and taking out the weight 28. In this instance, since the lead reservoir 29 is unitized as shown in FIG. 6, it can be easily detached without having to disassemble other parts, the operation can be made easily, and assembly can be made simply.

What is claimed is:

1. A writing instrument comprising: a barrel cylinder; a slider for frictionally holding a lead and being movably disposed at a front end of the barrel cylinder; a lead chuck disposed in the barrel cylinder rearwardly of the slider for releasably holding the lead so as to allow forward movement of the lead but prevent backward movement thereof, the lead chuck being movably disposed to undergo movement in an axial direction of the barrel cylinder; first urging means for urging the slider forward and the lead chuck backward so that when a writing front end of the writing instrument is released from a writing surface, the lead is automatically fed by urging the slider forward; a lead reservoir disposed rearwardly of the lead chuck to supply the lead to the lead chuck; a weight movably disposed around the outer periphery of the lead reservoir to undergo movement in the axial direction so as to abut against the rear end of the lead chuck; a weight-receiving cylinder movably disposed on the outer periphery of the lead reservoir and against which the weight abuts; and second urging means for urging the weight-receiving cylinder forward.

2. A writing instrument according to claim 1; wherein the weight of the weight is smaller than the spring load of the first urging means.

3. A writing instrument according to claim 1; wherein the first urging means comprises a slider spring disposed between the slider and the lead chuck and which urges the slider forward and urges the lead chuck backward.

4. A writing instrument according to claim 1; wherein the lead reservoir is disposed to undergo movement in the axial direction; and the second urging means comprises a knocking spring disposed between the weight-receiving cylinder and a flange of the lead reservoir and which urges the weight-receiving cylinder forward and urges the lead reservoir backward.

5. A writing instrument according to claim 1; wherein the barrel cylinder comprises a front cylinder, and a rear cylinder detachably connected to the front cylinder; the weight-receiving cylinder has a receiving flange which abuts against the rear end of the front cylinder; and the rear cylinder has an inner stepped portion which abuts against a flange formed on the lead reservoir.

6. A writing instrument according to claim 1; further comprising a sleeve fitted to the outer periphery of the lead chuck, the sleeve having a projection which engages with an axial groove formed on the barrel cylinder, and wherein the weight abuts against the rear end of the sleeve.

7. A writing instrument according to claim 1; further comprising a lead-supplying pipe formed at the front end of the lead reservoir and extending inside of the lead chuck.

8. A writing instrument according to claim 1; wherein the lead reservoir is movable in the axial direction and has a receiving groove formed at the outer periphery of the front end thereof; and the lead chuck has an enlargeable rear end having a sliding projection engageable in the receiving groove.

9. A writing instrument comprising: a barrel cylinder; a slider disposed to undergo axial movement in the barrel cylinder at a front end thereof for frictionally holding a lead; a lead chuck disposed in the barrel cylinder rearwardly of the slider to undergo forward axial movement to feed the lead to the slider and rearward axial movement; a first spring interposed between the slider and the lead chuck to urge the slider forward and to urge the lead chuck rearward; a lead reservoir disposed in the barrel cylinder rearwardly of the lead chuck to undergo forward axial movement to supply lead to the lead chuck and rearward axial movement; an impact member disposed on the lead reservoir to undergo axial movement therealong; a second spring interposed between the impact member and the lead reservoir to urge the impact member forward and the lead reservoir rearward; and a weight movably disposed in the barrel cylinder in a space between the barrel cylinder and the lead reservoir to undergo back-and-forth axial movement in response to shaking of the writing instrument so that the weight impacts the lead chuck at the end of its forward axial movement to effect forward axial movement of the lead chuck and impacts the impact member at the end of its rearward axial movement whereby the second spring absorbs the impact.

10. A writing instrument according to claim 9; wherein the weight has a tubular shape and is disposed around the outer periphery of the lead reservoir.

11. A writing instrument according to claim 9; wherein the impact member has a tubular shape and is disposed around the outer periphery of the lead reservoir.

12. A writing instrument according to claim 9; further comprising a sleeve fitted over a rear end portion of the lead chuck, the sleeve extending rearwardly of the lead chuck such that the weight impacts the rear end of the sleeve at the end of its forward axial movement.

13. A writing instrument according to claim 12; wherein the rear end of the sleeve is slidably disposed over the forward end of the lead reservoir to permit axial movement of the lead chuck and sleeve relative to the lead reservoir.

14. A writing instrument according to claim 12; wherein the sleeve has an outwardly extending projection engageable with an axial groove formed in the barrel cylinder.

15. A writing instrument according to claim 9; wherein the impact member has a flange that abuts against an inner step portion of the barrel cylinder.

16. A writing instrument according to claim 9; wherein the barrel cylinder comprises a front cylinder, and a rear cylinder detachably connected to the front cylinder such that detachment of the rear cylinder enables removal of the weight from the writing instrument.

17. A writing instrument according to claim 9; further comprising a lead-supplying pipe provided at the forward end of the lead reservoir and extending forwardly inside of the lead chuck.

18. A writing instrument according to claim 9; further comprising a knocking member engageable with the lead reservoir to effect forward axial movement of the lead reservoir.

19. A writing instrument according to claim 18; wherein the knocking member is movably disposed at the rear end of the barrel cylinder and engages with the rear end of the lead reservoir.

20. A writing instrument according to claim 9; wherein the weight of the weight is smaller than the spring force exerted by the first spring during use of the writing instrument in performing a writing operation.

* * * * *